United States Patent [19]

Oetiker et al.

[11] 4,197,123

[45] Apr. 8, 1980

[54] PROCESS FOR THE PRODUCTION OF MASKED POSITIVE COLOR IMAGES BY THE SILVER DYE BLEACH PROCESS

[75] Inventors: Alfred Oetiker, Fribourg; Christoph Chylewski; Max Marthaler, both of Marly, all of Switzerland

[73] Assignee: Ciba-Geigy AG, Basel, Switzerland

[21] Appl. No.: 924,476

[22] Filed: Jul. 13, 1978

[30] Foreign Application Priority Data

Jul. 21, 1977 [CH] Switzerland ..... 9060/77

[51] Int. Cl.[2] ..... G03C 7/04; G03C 7/16

[52] U.S. Cl. ..... 430/360; 430/391; 430/431; 430/503; 430/223

[58] Field of Search ..... 96/5, 6, 7, 8, 9, 20, 96/53, 73

[56] References Cited

U.S. PATENT DOCUMENTS

| | | | |
|---|---|---|---|
| 2,387,754 | 10/1945 | Gaspar | 96/5 |
| 2,629,657 | 2/1953 | Duerr et al. | 96/9 |
| 2,673,800 | 3/1954 | Meeussen et al. | 96/74 |
| 3,340,060 | 9/1967 | Meyer et al. | 96/20 |
| 3,615,536 | 10/1971 | Williams | 96/73 |
| 3,650,739 | 3/1972 | Marthaler et al. | 96/73 |
| 3,754,915 | 8/1973 | Oetiker et al. | 96/73 |
| 4,046,566 | 9/1977 | Marthaler | 96/6 |

*Primary Examiner*—Travis Brown

*Attorney, Agent, or Firm*—Sprung, Felfe, Horn, Lynch & Kramer

[57] ABSTRACT

The present invention provides a new process for the production of masked subtractive positive color images by the silver dye bleach process, which comprises the steps of exposure, silver developing, dye-bleaching, silver-bleaching and fixing. The photographic material used contains, in at least two layers, one image-wise bleachable dye per layer, the absorption maximum of the dye corresponding in each case to one of the three primary colors red, green and blue and a silver halide emulsion layer sensitive in a specific spectral region being allocated to each dye, wherein this material (a) in at least one layer contains a dye, the undesired secondary color density of which is to be compensated, and a silver halide emulsion containing silver iodide is allocated to this dye, in the same layer and/or an adjacent layer, (b) in at least one further layer contains at least one further dye, the main color density of which corresponds to a secondary color density, which is to be compensated, of the first dye, and also a silver halide emulsion free from iodide ions, (c) contains a further layer which is adjacent to layer (b) and contains colloidal nuclei which are able, under reducing conditions, to deposit metallic silver from soluble silver complexes, and also contains an insensitive iodide-free silver halide emulsion which is not spectrally sensitized, and optionally a stabilizer, and (d) containing a separating layer, which does not contain any of the dyes of the layer or layers (a), between the layer or layers (a) and the layer (c). The silver developing bath with which the material is treated contains ligands which form water-soluble and diffusible silver complexes with silver.

20 Claims, No Drawings

PROCESS FOR THE PRODUCTION OF MASKED POSITIVE COLOR IMAGES BY THE SILVER DYE BLEACH PROCESS

Photographic processes for the production of coloured images or for reproducing coloured originals operate virtually exclusively by the subtractive principle. In general, three superimposed layers are used on a transparent or opaque base and these layers each contain a partial image in the subtractive main colours cyan, magenta and yellow. It is thus possible to reproduce all of the colour shades within the colour space determined by the three main colours. By suitable choice of the image dyes it is thus possible satisfactorily to reproduce the colours occurring in nature or in the original, in respect of tonality and saturation. The prerequisite for this is a favourable mutual balance within the dye triple and a high saturation of the individual primary colours.

Under practical conditions, however, a difficulty arises which cannot easily be overcome by simple photographic means: this is because the dyes which are available for the reproduction of the three main colours cyan, magenta and yellow all have, in addition to the desired absorption in one of the three complementary primary colours red, green or blue, at least one further absorption range, even though this is weaker, in a spectral region assigned to the other two primary colours. This so-called secondary colour density does not in itself prevent the reproduction of all of the colour values and brightness values occurring within the colour space; it has, however, the result that a change in the colour density within a colour layer, such as can be obtained by known photographic processes with the aid of a correspondingly sensitised silver halide emulsion, affects both the main colour density and also the secondary colour density. This results in undesired colour shifts and saturation losses, which considerably interfere with the truth of colour when an original is reproduced.

In principle, secondary colour densities are present in all three subtractive main colours: in the case of yellow (main absorption in the blue) in the red and green, in the case of magenta (main absorption in the green) in the red and blue and in the case of cyan (main absorption in the red) in the green and blue. The secondary colour densities of the magenta and cyan dyes in the blue are particularly strong and therefore troublesome. The secondary colour density of the cyan dye in the green is somewhat less troublesome and the secondary colour densities of the yellow dye in the red and green are troublesome to an even lesser extent. The consequence of this is that in particular the reproduction of clear blue and red shades in photographic colour materials is always associated with difficulties.

There has been no lack of attempts to eliminate or at least to lessen this fundamental defect of the photographic colour materials in various ways. Since it has not been possible hitherto to find any cyan, magenta and yellow dyes without troublesome secondary colour densities, the aim had to be achieved indirectly: the basis of one of the processes known as masking is that, in additional layers with opposing gradation, the undesired secondary colour density of a dye is compensated in such a way that, independently of the particular main colour density, the sum of the secondary colour densities in the layer to be masked and the masking layer remains constant. When used consistently for all six secondary colour densities, however, the result of this process is that it is no longer possible to obtain pure white shades (=absence of any colour density), but at best neutral grey shades can be obtained. The process is therefore suitable in particular for the production of colour negatives or for reproduction processes, the production of colour separations and the like, that is to say processes in which the said disadvantage can be compensated again in the subsequent printing or reproduction stage.

The masking processes have found wide acceptance in the field of colour photography, which uses chromogenous processes for colour developing. Various effects are utilised for masking. Thus, for example, the residual silver remaining after developing can be used to form a mask image of opposing gradation, as is described in German Patent Specification Nos. 743,535 and 898,709 or in Swiss Patent Specification No. 271,389. Other patent specifications, such as German Patent Specification No. 950,617 or British Patent Specification Nos. 665,657, 714,012 and 1,210,893, describe the production of a mask image by chemical conversion of the residual colour coupler which has not been consumed during colour developing.

Masked colour images, which are used for the production of colour prints or as colour separations for the production of printing plates for reproduction, can also be obtained by registering the compensating colour images on separate bases and superimposing the latter, together with the original, before the printing process. Processes of this type are described, for example, in German Patent Specification Nos. 975,867, 976,138, 976,904 and 965,615 and in German Auslegeschrift No. 1,142,757 and also in British Patent Specification No. 903,050.

Masking processes have also been disclosed for the production of subtractive positive images by the silver dye bleach process. Thus, for example, the combination of layers with negative emulsions with those which contain a direct-positive emulsion has been disclosed in U.S. Pat. No. 2,387,754. In this case, opposing partial images of the desired colour are formed on developing and dye-bleaching.

The processes described in these patents are suitable for the production of colour separations, for example for reproduction purposes. However, because of the residual colour density which remains even in the image areas, which should be white, these processes are not suitable for the direct production of positive images of a coloured original. Only partial masking, with which no further light absorption takes place in the image areas which have remained white, is permissible here.

In U.S. Pat. No. 2,673,800, it has already been shown that the known process of silver complex diffusion can be used for the production of negative images by the silver dye bleach process. The effect described in this specification can be utilised, by means of additional measures, especially by specific layer arrangements and the utilisation of the iodide ion diffusion, which is also known, for masking images by the silver dye bleach process. A process in which, in a silver dye bleach material, a sensitivity shift in the various layers takes place, as a result of a combination of the said effects, depending on the exposure, in the individual partial ranges, in such a way that the desired masking effect is achieved has been described in U.S. Pat. No. 4,046,566.

The process according to the last-mentioned U.S. Patent Specification is based on the fact that, in a silver dye bleach material containing several colour layers which absorb in different spectral regions, a silver halide emulsion which is free from iodide or has a low iodide content is allocated to one or more of these colour layers, the main colour density of which corresponds to a secondary absorption to be corrected in another layer, and, in the immediate vicinity of this emulsion, a layer containing colloidal nuclei suitable for physical silver developing is arranged, whilst, at the same time, iodide-containing silver halide emulsions are assigned to those colour layers in which the undesired secondary absorption is to be masked. If, after corresponding image-wise exposure, a system of this type is treated with a developer which contains a silver halide complexing agent, an enrichment of silver takes place as a result of physical developing in the nuclei-containing layer which is adjacent to the first-mentioned layer, and in the subsequent processing step of dye bleaching this gives rise, as a result of the remote bleaching effect described in U.S. Pat. No. 3,650,739, 3,754,915, 3,743,506, to additional dye bleaching in the adjacent colour layer.

When the iodide-containing emulsions assigned to the other colour layers are partially exposed at the same time, an elimination and migration of iodide ions takes place during silver developing. These ions inhibit the physical developing in the nuclei-containing layer in a manner known per se and form in this layer a mask image which is the inverse of the negative images formed in the iodide-containing emulsion layers. The way in which this mask image controlled by several layers is utilised to produce a series of different masking effects and the way in which the process can be used to produce images with improved colour reproduction has been described in detail in U.S. Pat. No. 4,046,566.

It has now been found that the process described in U.S. Pat. No. 4,046,566 for making positive colour images by the silver dye bleach process can be improved and, in particular, an intensified masking effect can be produced when a relatively insensitive iodide-free silver halide emulsion and, optionally, a stabilizer with a development inhibitor effect are also added to the layer which contains the colloidal nuclei.

The present invention therefore relates to a process for the production of masked subtractive positive colour images by the silver dye bleach process, by exposure, silver developing, dye-bleaching, silver-bleaching and fixing, and using a photographic material which contains, in at least two layers, one image-wise bleachable dye per layer, the absorption maximum of the dye corresponding in each case to one of the three primary colours red, green and blue and a silver halide emulsion layer sensitive in a specific spectral region being allocated to each dye, wherein this material (a) in at least one layer contains a dye, the undesired secondary colour density of which is to be compensated, and a silver halide emulsion containing silver iodide is allocated to this dye, in the same layer and/or an adjacent layer, (b) in at least one further layer contains at least one further dye, the main colour density of which corresponds to a secondary colour density, which is to be compensated, of the first dye, and also a silver halide emulsion free from iodide ions and (c) contains a further layer which is adjacent to layer (b) and contains colloidal nuclei which are able, under reducing conditions, to deposit metallic silver from soluble silver complexes, and also contains an insensitive iodide-free silver halide emulsion which is not spectrally sensitised and, optionally a stabiliser, there being (d) a separating layer, which does not contain any of the dyes of the layer or layers (a), between the layer or layers (a) and the layer (c), and wherein the silver developing bath contains ligands which form water-soluble and diffusible silver complexes with silver.

The stabiliser in layer (c) can retard the dissolution and physical developing of the said non-sensitised emulsion and by this means the desired masking effect can be further intensified.

The invention also relates to the silver dye-bleach material which is suitable for carrying out the process and is built up as indicated above and also to a silver dye-bleach material the optical density of which is increased, in at least one image dye layer, the main colour density of which corresponds to the secondary colour density to be compensated, by an amount which compensates the loss in density after processing in the unexposed state.

A substance which is allocated to another is here to be understood as meaning substances which belong to the same layer of a photographic material or to two adjacent layers and which can interact with one another.

Processes in which the development inhibiting action of iodide ions diffusing in from another layer is used to produce an opposing mask image have already been disclosed for example, in German Offenlegungsschrift No. 2,615,344. In this Offenlegungsschrift, a photographic reversal material is described which consists of iodide-containing silver halide emulsions of different spectral sensitivities and in which the layers preferably can also contain chromogenous couplers in order to produce a colour image. One of the layers containing silver halide—termed "affected layer" in the said Offenlegungsschrift—also contains, in addition to the silver halide emulsion, fogged silver halide grains which can be developed without exposure, as well as, preferably, an antifogging agent for the non-fogged emulsion. On initial developing of the exposed material, the fog grains are completely developed to silver, independently of the exposure of the other grains of the layer. The amount of silver corresponding to the fog grains is consequently inactive during the subsequent second exposure and colour developing of the non-exposed parts of the emulsion and produces no dye constituent in the finished image. If, however, parts of the emulsion in the adjacent layers sensitised to different spectral regions (termed "affecting layers" in the said Offenlegungsschrift) are exposed and subjected to initial developing, iodide ions are set free and these migrate into the "affected" layer containing the fog grains and inhibit developing of the latter. In these areas, therefore, more silver is available for the second developing; an intensified reversal image controlled by the adjacent layers thus forms in the "affected layer".

The process according to German Offenlegungsschrift No. 2,615,344 thus gives a positive reversal image with a masking effect controlled by the adjacent layers.

The process according to the present invention differs from the process described in U.S. Pat. No. 4,046,566 in that the layer which contains the colloidal nuclei additionally also contains an insensitive iodide-free silver halide emulsion which has not been spectrally sensitised and also, if desired, contains a non-diffusible stabiliser. The use of these additional constituents increases the masking effect, as will be explained in more detail below:

In the known process according to U.S. Pat. No. 4,046,566, the silver necessary for the build-up of the mask image in the nuclei-containing layer originates in the main from the non-exposed grains of the adjacent layer containing an iodide-free silver halide emulsion. This layer at the same time contains the dye, the main spectral absorption of which corresponds to the secondary colour density to be masked in the other colour layers. If this layer is now strongly exposed, virtually all of the emulsion grains will be developed to metallic silver during the subsequent developing process and as a result of this virtually no further soluble silver halide remains available for transport into the nuclei-containing adjacent layer. This disadvantage can be eliminated when, according to the invention, the nuclei-containing layer is combined with an insensitive iodide-free silver halide emulsion. By this means, the silver necessary for the build-up of the mask image is available even if the adjacent colour layer has been completely exposed throughout. Moreover, since the insensitive emulsion and the developer nuclei are in the same layer, the transport path for the dissolved silver complex is shorter.

It has also been found that the use of a stabiliser in the insensitive emulsion even further intensifies the desired effect. This action is presumably due to the processes of dissolving and physical developing of the emulsion grains on the one hand and of migration of the development inhibiting iodide ions from the other layers on the other hand being controlled as a function of time.

Intensified masking effects can be achieved by the process according to the invention; in particular, the masking effect is still effective even if the dye-containing emulsion layer adjacent to the nuclei-containing layer has been exposed exhaustively.

The processes which take place under the given preconditions during processing will be explained below with the aid of a material containing two image dyes.

The material used is, for example, a material which consists of the following layers, in the given sequence from bottom to top, on an opaque base:

1. A layer containing a magenta dye and an iodide-containing, green-sensitised silver bromide emulsion.
2. A gelatine layer containing neither emulsion nor dye.
3. A layer (nuclei-containing layer) containing a small proportion of (yellow) colloidal silver, a non-sensitised, insensitive and iodide-free silver halide emulsion and optionally a stabiliser.
4. A yellow dye layer containing an iodide-free, blue-sensitive silver bromide emulsion.
5. A protective layer containing neither emulsion nor dye.

If a material of this type is now exposed behind a grey wedge and subsequently developed in the manner described, with the addition of a ligand forming soluble complexes, and fully processed, the following processes take place A. unexposed areas (maximum density of the copying wedge):

Due to the silver solvent in the developer, a diffusible complex forms from the silver halide in all of the unexposed emulsions and especially also from the silver halide emulsion present in the nuclei-containing layer and this complex is deposited as metallic silver in the nuclei-containing layer (colloidal silver). The silver halide emulsion adjacent to the nuclei and included in the same layer is particularly effective. During subsequent dye-bleaching, the yellow layer is incipiently bleached from below by remote bleaching. The magenta layer is protected against remote bleaching by the gelatine separating layer.

B. On exposure to blue light;

The blue-sensitive emulsion in the yellow layer contains a latent image. The green-sensitive emulsion in the magenta layer remains unexposed since the blue spectral fraction of the copying light is reduced to a sufficient extent by the yellow dye and the yellow colloidal silver. The insensitive emulsion in the nuclei-containing layer likewise remains unexposed. On developing, the latent image in the yellow layer is developed to metallic silver; the emulsions contained in the magenta layer and in the nuclei-containing layer, on the other hand, do not receive a latent image; consequently, no silver developing takes place in these layers. At the same time, diffusible complexes form from the silver halide in the nuclei-containing layer and also, in some cases, from unexposed silver halide in the adjacent yellow dye layer and these complexes are reduced to metallic silver on the nuclei. The amount of this silver in the nuclei-containing layer is substantially independent of the exposure to blue light, since an adequate amount of silver halide for complex formation is always available from the amount of emulsion which is present in the nuclei-containing layer and is insensitive to light and, during developing, no iodide ions are formed which prevent physical developing on the nuclei.

On subsequent dye-bleaching, the yellow dye is bleached by the silver image developed in the layer. In addition, a substantially constant proportion of yellow dye is bleached out by remote action from the nuclei-containing layer. As a result of this, less dye remains in the yellow layer after processing, i.e. the yellow layer is apparently more sensitive than would be the case if no physical developing had taken place in the nuclei-containing layer.

C. On exposure to green light:

The blue-sensitive layer remains unexposed; a latent image forms in the green-sensitive emulsion. On developing, soluble silver complexes again form, inter alia, from the insensitive iodide-free emulsion in the nuclei-containing layer. At the same time, however, in this case the iodide-containing, green-sensitive emulsion is developed. On reduction of the silver halide, iodide ions are set free and these migrate into the nuclei-containing layer and prevent physical developing of the dissolved silver complexes in this layer. The stabiliser which may also be present in the nuclei-containing layer is also able additionally to retard physical developing until the iodide ions which migrate in from the magenta layer are able to act. Thus, in the nuclei-containing layer a silver image forms which is controlled by the exposure to green light and is the inverse of the silver image developed in the green-sensitive emulsion.

On subsequent dye-bleaching, the magenta dye is degraded proportionally to the silver developed in this layer. The yellow layer is partially bleached by remote action from the silver image of the nuclei-containing layer. After complete processing, a yellow image, the density of which is dependent on the exposure to green light, remains in the yellow layer. The yellow density in this image increases with increasing exposure to green light and with decreasing magenta density.

D. Exposure to blue and green (or white) light:

A latent image forms both in the blue-sensitive yellow layer and in the green-sensitive magenta layer. On developing, the same silver image as in (B) is developed in the yellow layer and the silver image according to (C) is developed in the magenta layer. In the nuclei-containing layer, a silver image which is the inverse of that in the magenta layer forms as under (C).

During dye-bleaching, the same colour image as in the case of exposure to green light only (C) forms in the magenta layer. In the yellow layer, on the other hand, although the silver developed in the layer itself effects dye-bleaching (analogous to B), the additional bleaching from the nuclei-containing layer, on the other hand, becomes weaker with increasing exposure to green light. Thus, more dye remains in the yellow layer than if there had been no exposure to green light. This means that the yellow layer in effect is less sensitive when exposure is not to blue light only but to both blue and green light.

The overall picture is thus as follows: under exposure conditions under which the green-sensitive layer is not exposed, i.e. when a large amount of magenta dye remains, a certain proportion of yellow dye is bleached out. This corresponds to a compensation of the blue secondary colour density of the magenta dye. The difference between the sensitivity of the yellow layer when the latter is exposed to blue light only (higher sensitivity, B) and that when it is exposed to blue and green light (lower sensitivity, D) is a criterion for the desired masking effect. The combination of the nuclei-containing layer with a separating layer ensures that the silver deposited in the nuclei-containing layer can act only in one direction, specifically in the desired direction.

It can easily be seen that a number of different masking effects can be achieved by the process described. Depending on the arrangement of the layers in the total layer assembly, it is possible for one or two secondary colour densities of one image dye to be compensated or for one secondary colour density of two image dyes to be compensated.

In addition, for example, those layer arrangements are possible in which two iodide-free emulsion layers and one iodide-containing emulsion layer are so combined with only one nuclei-containing layer that only one secondary colour density from each colour layer is compensated.

The general case is that in which the dye and the associated emulsion sensitised in the colour complementary to the primary colour are present in the same layer. These correlated components can, however, also be distributed, at least in part, in two or even three different layers adjacent to one another.

In these layers one of the two components image dye and sensitised silver halide emulsion is then not present or present only in part. Such layer arrangements have been described, for example, in U.S. Pat. Nos. 3,650,739, 3,754,915, 3,743,506.

They are used in particular to influence the relatively steep gradation in silver dye-bleach materials or to increase the sensitivity. However, there is a restriction in respect of the layer which contains that dye having a main colour density which corresponds to a secondary colour density to be masked, as can already be seen from the above description of the material: the iodide-free silver halide emulsion belonging to this dye must be arranged in the layer itself, i.e. as close as possible to the associated dye. However, it is possible also to allocate an additional emulsion layer to this latter dye in an adjacent layer, the additional layer in this case having to be located on that side of the dye layer which faces away from the nuclei-containing layer.

This additional emulsion layer is preferably likewise iodide-free or can optionally also contain a small amount of iodide ions, by which means the extent of the desired masking effect can be controlled. It is also possible to choose spectral sensitivities other than those in the particular complementary colour for the emulsions assigned to the individual dye layers. Such variants, which are suitable for building up so-called false colour films, have been described, for example, in U.S. Pat. No. 3,743,506.

Silver dye-bleach materials for the reproduction of coloured originals are in general trichromatic and contain three colour layers, one in each of the subtractive primary colours yellow, magenta and cyan. In order to achieve special effects, however, materials with other colours or with only two colour layers can also be used. Moreover, the image dyes which can be used are the yellow, magenta and cyan dyes known per se for this purpose, in combination with the appropriate spectral sensitisers.

The light-sensitive silver halide emulsions used are usually those which contain silver chloride, silver bromide or silver iodide or mixtures of these halides. Iodide-containing silver halide emulsions usually contain between 0.1 and 10 mol percent of silver iodide; the remainder consists of silver chloride and/or silver bromide (for example 0 to 99.9 mol percent of silver chloride and 0 to 99.9 mol percent of silver bromide). Iodide-free silver halide emulsions preferably contain silver chloride, silver bromide or a silver chloride/silver bromide mixture. The iodide-free silver halide emulsions in the nuclei-containing layer are not sensitised.

Gelatine is customarily used as the protective colloid for the preparation of these emulsions; however, other water-soluble protective colloids, such as polyvinyl alcohol or polyvinylpyrrolidone and the like, can also be used; furthermore, some of the gelatine can be replaced by dispersions of high molecular weight substances which are not soluble in water. For example, it is customary to use dispersion polymers of $\alpha,\beta$-unsaturated compounds, such as acrylates, vinyl esters and vinyl ethers, vinyl chloride and vinylidene chloride and also of other mixtures and copolymers.

Suitable colloidal nuclei for depositing metallic silver from silver complex compounds are, for example, colloidal hydrosols of noble metals, such as gold, silver or palladium, and also metal sulphides, such as nickel sulphide or silver sulphide. Since these nuclei have to be introduced only in a very small amount, for example 1 mg to 200 mg per $m^2$, interference due to light absorption or light scattering is in general not to be feared. However, the nuclei preferably introduced into the layer are those, which subsequently can be removed again, for example during processing. A hydrosol of colloidal silver, which can be removed from the material again without difficulty in the silver bleaching process, is particularly suitable for this purpose. The yellow silver hydrosol which can be incorporated directly below the yellow dye layer in a yellow filter layer intended to absorb the blue radiation is particularly suitable.

If metallic silver is deposited on the nuclei during developing in the presence of a silver complexforming agent, care must be taken that during the subsequent dye-bleaching this metallic silver acts only in the desired direction, i.e. on the colour layer in which the dye is present together with the preferably iodide-free silver halide emulsion. It is therefore necessary to arrange a barrier layer or separating layer with respect to the further colour layers which have a secondary colour density to be masked and to which an iodide-containing silver halide emulsion is assigned. Such a separating layer generally consists of pure binder, for example gelatine, and contains neither dye nor silver halide emulsion. If it is advantageous for the total layer arrangement, however, an already existing emulsion layer or a filter layer or the like can, if desired, also serve as the separating layer. In addition to gelatine, the separating layer can also contain further additives, such as substances which inhibit dye-bleaching, additional binders, for example water-soluble colloids or water-insoluble dispersion polymers, and also the additives customary for building up photographic layers, such as softeners, wetting agents, light stabilisers, filter dyes or hardeners.

Suitable stabilisers are the sulphur-containing compounds of one of the following categories, which are known as antifogging agents: aliphatic sulphur compounds, mercaptothiazolium salts, mercaptotriazolium salts, mercaptotetraazaindenes, mercaptotetrazoles and in some cases further compounds the silver salts of which have a solubility between that of silver bromide and that of silver sulphide. The stabilisers are bonded by adsorption, in a non-diffusing manner, to the particles of the non-sensitised, iodide-free silver halide emulsion of layer (c).

The following compounds are particularly suitable stabilisers: cysteine, 2-mercaptobenzthiazole, N-methylmercaptotriazole and phenylmercaptotetrazole, the latter being preferred.

The emulsion used as the insensitive emulsion which is present in the nuclei-containing layer can be a fine-grained emulsion which consists of silver chloride, silver bromide or silver chlorobromide and in general is not spectrally sensitised and is so insensitive that on exposure under which the light-sensitive emulsions of the other layers are exposed to saturation no developable grains are formed, which could interfere with the production of the image.

If a silver chlorobromide emulsion is used, the proportion of silver chloride is about 10–90 mol % and preferably 30–70 mol %; furthermore, the emulsion should preferably be iodide-free.

The average grain diameter is in general approximately 0.05 μ–1.2 μ and preferably 0.4 μ–0.8 μ.

As indicated, the exposed silver halide layers are developed in the presence of a silver halide solvent, i.e. a compound which is able to form water-soluble, diffusible complexes with silver ions. Suitable silver halide solvents or silver ligands are, for example, the alkali metal salts, such as the sodium salt and potassium salt, or the ammonium salt of thiosulphuric acid and also salts of thiocyanic acid. However, the salts of thiosulphuric acid are preferred, especially sodium thiosulphate. One litre of developing bath should contain, for example, between 0.05 and 5 g of the said salts, especially sodium thiosulphate, and the optimum amount can vary within the indicated limits depending on the nature of the material, the temperature of the developing bath and the desired period of action.

EXAMPLE (a) A material, suitable for the production of positive reflection copies of a positive original, for the silver dye bleach process was prepared as follows:

The following layers were applied in the indicated sequence to a white-opaque base:

A red-sensitised layer pair consisting of

1(a) a red-sensitive gelatine/silver bromide/silver iodide emulsion layer, containing a bleachable cyan azo dye of the formula (1), with a silver content of 0.144 g of Ag/m²;

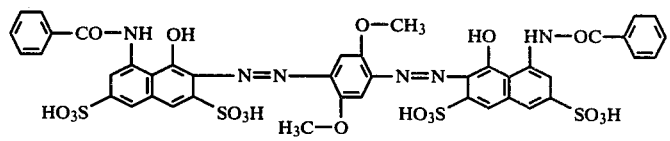

(1)

1(b) a layer which is free from image dye and consists of a red-sensitive gelatine/silver bromide/silver iodide emulsion with a silver content of 0.300 g of Ag/m²;

(2) a first gelatine interlayer; a green-sensitised layer pair consisting of

3(a) a green-sensitive gelatine/silver bromide/silver iodide emulsion layer which contains a magenta bleachable azo dye of the formula (2) and has a silver content of 0.212 g of Ag/m²;

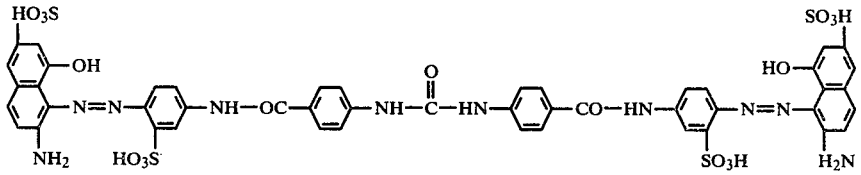

(2)

3(b) a layer which is free from image dye and consists of a green-sensitive gelatine/silver bromide/silver iodide emulsion with a silver content of 0.375 g of Ag/m²;

(4) a second interlayer consisting of gelatine to which colloidal silver has been added in an amount of 0.007 g of Ag/m² and an insensitive silver bromide emulsion which has not been spectrally sensitised and has a silver content of 0.2 g of Ag/m²; a blue-sensitive layer pair consisting of 5(a) a highly sensitive, iodide-free gelatine/silver bromide layer which contains a yellow bleachable azo dye of the formula (3) and has a silver content of 0.360 g of Ag/m²;

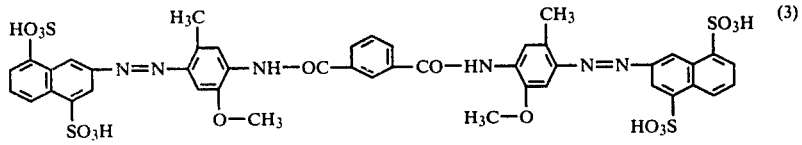

(3)

5(b) a dye-free, highly sensitive gelatine/silver bromide/silver iodide layer which has a low iodide content and a silver content of 0.530 g of Ag/m²; and (6) a gelatine protective layer.

This material is built up in such a way that on processing with a developer containing a silver ligand, especially sodium thiosulphate, and on carrying out the subsequent process steps of dye-bleaching and silver-bleaching which are necessary for the silver dye bleach process and preferably are combined in a single step, and finally fixing, masking of the blue secondary colour densities of the magenta and cyan layers is effected, as a result of which the prints produced with this material have considerably clearer blue, green and red shades than is the case with a material which has been processed in a thiosulphate-free developer.

In order to test and measure the masking effect, one test strip of the material is exposed monochromatically through a blue wedge and a further test strip is exposed polychromatically through a grey wedge and the strips are processed in the manner indicated further below. Under these conditions, the masking effect manifests itself in an increased sensitivity of the blue-sensitive layer under the conditions of monochromatic exposure to blue light. Under these conditions, an increased proportion of the yellow dye is bleached out under the action of the additional silver physically developed in the muclei-containing layer. On the other hand, this additional bleaching is prevented image-wise in the case of polychromatic exposure, by the iodide-ions migrating in from the red-sensitive and green-sensitive layers. In order to measure the sensitivity, the radiant energy required to obtain an analytical colour density of 0.1 over fog is measured in logarithmic units. The difference in energy (Δ log E) for the same blue density in polychromatic and monochromatic exposure to blue light is defined as a criterion for the masking effect.

A test strip (A1) was cut from the material described above and exposed monochromatically through a blue wedge. A second test strip (A2) was exposed polychromatically through a grey wedge.

The following processing solutions were used in the indicated sequence for processing the exposed test strips:

| 1. Silver developing bath | 3 minutes | Temperature |
|---|---|---|
| sodium polyphosphate | 1 g/l | 30° C. |
| potassium hydroxide (85%) | 27 g/l | |
| boric acid | 21 g/l | |
| potassium metabisulphite | 18 g/l | |
| anhydrous sodium sulphite | 11 g/l | |
| 1-phenyl-3-pyrazolidinone | 0.3 g/l | |
| hydroquinone | 5 g/l | |
| benztriazole | 0.6 g/l | |
| potassium bromide | 2 g/l | |
| anhydrous sodium thiosulphate | 1.0 g/l | |
| 2. Washing | 1 minute | |
| 3. Bleaching bath | 6 minutes | |
| sulphuric acid (96%) | 30 ml/l | |

-continued

| | |
|---|---|
| sodium m-nitrobenzenesulphonate | 8 g/l |
| 1-thioglycerol or 3-mercapto-1,2-propanediol | 1 ml/l |
| potassium iodide | 6 g/l |
| catalyst (2,3,6-trimethyl-quinoxaline) | 2 g/l |
| 4. Washing | 2 minutes |
| 5. Fixing bath | 4 minutes |
| ammonium thiosulphate | 250 g/l |
| potassium metabisulphite | 50 g/l |
| potassium hydroxide (85%) | 20 g/l |
| 6. Washing | 6 minutes |
| Total processing time | 22 minutes |

(b) A silver dye bleach material built up analogously to Example (a) was produced, except that 2 mg of phenylmercaptotetrazole per g/Ag were additionally present as a stabiliser in layer No. 4 containing the colloidal silver nuclei.

Two test strips (B1) and (B2) were cut from this material and exposed monochromatically through a blue wedge and, respectively, polychromatically through a grey wedge, as described in Example (a), and then further treated in the same way as in Example (a).

(c) A silver dye bleach material built up analogously to Example (a) was produced except that neither a non-sensitised silver bromide emulsion nor a stabiliser was present in layer No. 4 containing the colloidal silver nuclei.

Two test strips (C1) and (C2) were cut from this material and exposed monochromatically through a blue wedge and, respectively, polychromatically through a grey wedge, as described in Example (a), and then further treated in the same way as in Example (a).

The following table shows the result of the sensitometric test on the test strips developed according to Examples (a), (b) and (c):

| Test strip | Colloidal silver layer No. 4: AgBr emulsion g of Ag/m² | Colloidal silver layer No. 4: Stabiliser mg/m² | Energy difference log E (0.1 above fog) |
|---|---|---|---|
| (A 1) | 0.200 | — | |
| (A 2) | 0.200 | — | 0.66 |
| (B 1) | 0.200 | 0.4 | |
| (B 2) | 0.200 | 0.4 | 0.76 |
| (C 1) | — | — | 0.56 |
| (C 2) | — | — | (comparison) |

As can be seen from the table, the masking effect, measured by the difference in the sensitivities on exposure to blue light and on exposure to grey light, is improved by the measures according to the invention. The greatest effect is evident when both an insensitive emulsion and an additional stabiliser are present in the nuclei-containing layer.

What is claimed is:

1. A process for the production of masked subtractive positive colour images by the silver dye bleach process, by exposure, silver developing, dye-bleaching, silver-bleaching and fixing, and using a photographic material which contains, in at least two layers, one image-wise bleachable dye per layer, the absorption maximum of the dye corresponding in each case to one of the three primary colours red, green and blue and a silver halide emulsion layer sensitive in a specific spectral region being allocated to each dye, wherein this material (a) in at least one layer contains a dye, the undesired secondary colour density of which is to be compensated, and a silver halide emulsion containing silver iodide is allocated to this dye, in the same layer and/or an adjacent layer, (b) in at least one further layer contains at least one further dye, the main colour density of which corresponds to a secondary colour density, which is to be compensated, of the first dye, and also a silver halide emulsion free from iodide ions and (c) contains a further layer which is adjacent to layer (b) and contains colloidal nuclei which are able, under reducing conditions, to deposit metallic silver from soluble silver complexes, and also contains an insensitive iodide-free silver halide emulsion which is not spectrally sensitised and optionally a stabiliser, there being (d) a separating layer, which does not contain any of the dyes of the layer or layers (a), between the layer or layers (a) and the layer (c), and wherein the silver developing bath contains ligands which form water-soluble and diffusible silver complexes with silver.

2. A process according to claim 1, wherein the iodide-free silver halide emulsion present in layer (c) is a non-sensitised silver chloride, silver bromide or silver chlorobromide emulsion.

3. A process according to claim 1, wherein layer (c) contains a stabiliser.

4. A process according to claim 3, wherein an aliphatic mercapto compound, a mercaptotetraazaindene, a mercaptotetrazole, a mercaptothiazolium salt or a mercaptotriazolium salt is used as the stabiliser and is bonded by adsorption, in a non-diffusing manner, to the particles of the non-sensitised, iodide-free silver halide emulsion of layer (c).

5. A process according to claim 1, wherein the silver halide emulsions allocated to the image dyes have spectral sensitivities in the particular colour complementary to the image dye.

6. A process according to claim 1, wherein the silver halide emulsions allocated to the image dyes have spectral sensitivities other than those in the particular complementary colour.

7. A process according to claim 1, wherein the photographic material has additional layers in which at least one of the two components image dye and silver halide is lacking, at least in part.

8. A process according to claim 1, wherein a trichromatic material is used which contains, as the image dye, a cyan dye, a magenta dye and a yellow dye, each in individual layers.

9. A process according to claim 1, wherein the sensitised silver halide emulsions allocated to the individual image dyes are present in the same layer as the image dyes appertaining thereto.

10. A process according to claim 1, wherein the sensitised silver halide emulsions allocated to the individual image dyes are present, at least in part, in a layer adjacent to the dye layer.

11. A process according to claim 1, wherein one secondary colour density of an image dye in a multilayer material is compensated.

12. A process according to claim 1, wherein two secondary colour densities of an image dye in a multilayer material are compensated.

13. A process according to claim 1, wherein one secondary colour density of two image dyes in a multilayer material is compensated.

14. A process according to claim 1, wherein the emulsion layers which are free from silver iodide and are allocated to a dye contain silver chloride or silver bromide or a mixture of the two halides.

15. A process according to claim 1, wherein the emulsions containing silver iodide contain 0 to 99.9 mol % of silver chloride, 0 to 99.9 mol % of silver bromide and 0.1 to 10 mol % of silver iodide.

16. A process according to claim 1, wherein the nuclei able to deposit metallic silver consist of colloidal silver.

17. A process according to claim 16, wherein the nuclei able to deposit metallic silver are present in the form of a yellow silver sol in a yellow filter layer.

18. A process according to claim 1, wherein the silver ligand used during developing is an alkali metal salt or ammonium salt of thiosulphuric acid and between 0.05 and 5 g of these salts are used per litre of developing bath.

19. A silver dye bleach material for carrying out the process according to claim 1.

20. A silver dye bleach material according to claim 19, wherein the optical density of at least one image dye layer, the main colour density of which corresponds to the secondary colour density to be compensated, is increased by an amount which compensates the loss in density after processing in the unexposed state.

* * * * *